United States Patent [19]

Bidanset

[11] Patent Number: 4,912,848

[45] Date of Patent: Apr. 3, 1990

[54] POWER TOOL HANDLE

[75] Inventor: Edward J. Bidanset, Charlotte, N.C.

[73] Assignee: Textron, Inc., Providence, R.I.

[21] Appl. No.: 295,115

[22] Filed: Jan. 9, 1989

[51] Int. Cl.[4] ..... B27B 17/02

[52] U.S. Cl. ..... 30/383; 30/517; 29/450; 29/525.1; 173/162.2

[58] Field of Search ..... 30/381, 382, 383, 384, 30/385, 386, 387, 514, 517; 173/162.2; 29/525.1, 450; 74/543

[56] References Cited

U.S. PATENT DOCUMENTS

| | | | |
|---|---|---|---|
| 3,368,595 | 2/1968 | Gutjahr | 143/32 |
| 3,496,971 | 2/1970 | Hale | 30/381 X |
| 3,620,269 | 11/1971 | Lange | 143/32 |
| 3,637,029 | 1/1972 | Sherwood, Jr. et al. | 173/162 |
| 3,698,455 | 10/1972 | Frederickson et al. | 30/381 |
| 3,700,015 | 10/1972 | Kobayashi et al. | 143/32 R |
| 3,728,793 | 4/1973 | Makinson et al. | 30/383 |
| 3,823,474 | 7/1974 | Ionescu | 30/383 |
| 3,934,344 | 1/1976 | Inaga | 30/381 |
| 3,945,119 | 3/1976 | Nagashima et al. | 30/383 |
| 4,059,895 | 11/1977 | Hirschkoff | 30/382 |
| 4,219,932 | 9/1980 | Nagashima et al. | 30/381 |
| 4,411,071 | 10/1983 | Takahashi et al. | 30/381 |
| 4,693,036 | 9/1987 | Wehle | 30/383 |
| 4,785,540 | 11/1988 | Arvidsson | 30/381 X |
| 4,805,308 | 2/1989 | Ritola | 30/382 |

OTHER PUBLICATIONS

Homelite Parts List for 540 Chain Saw, Homelite Division of Textron Inc., part No. 18087.

*Primary Examiner*—Douglas D. Watts
*Assistant Examiner*—Rinaldi Rada
*Attorney, Agent, or Firm*—Perman & Green

[57] ABSTRACT

A handle for a chain saw comprises a first U-shaped member and a second U-shaped member. The two members are connected to each other. The first member is connected to a bottom of a chain saw and the second member has a side bar that is connected to the body of the chain saw. The two members provided a handle that completely encircles the body of the chain saw to form a structurally rigid closed loop having multiple grasping positions which is relatively easy to assembly with the chain saw.

16 Claims, 2 Drawing Sheets

POWER TOOL HANDLE

BACKGROUND OF THE INVENTION

1. Field of the Invention

This invention relates to hand-held power tools and, more particularly, to a handle for use with hand-held power tools and a method of mounting the handle onto a power tool.

2. Prior Art

Chain saws and other hand-held power tools are commonly driven by a small light weight internal combustion engine normally operating at a relatively high speed of over 5000 rpm. A power tool commonly has at least one handle such that the operator can securely hold the tool and manipulate the tool as desired. For a power tool such as a chain saw, the chain saw generally comprises two handles; a rear handle formed from the chain saw housing and intended to be grasped by a first hand of an operator and a forward second handle intended to be grasped by the other hand of the operator. Various different shapes and types of chain saw front handles have been disclosed in the prior art. However, it has been found to be desirable to provide a relatively large front handle for the operator of the chain saw to grasp the handle at various locations such that the operator can more properly operate and manipulate the chain saw with added safety.

Generally, in locations such as the west coast of the United States, trees having 3 or 4 feet diameters are located on sloped mountain sides. In order for an operator to cut these types of trees, due to the relative direction of growth, an operator must be able to not only orient the chain saw at different angles, but also operate the chain saw from either the right or left side of the chain saw. It is therefore an objective of the present invention to provide a handle for a power tool such as a chain saw which allows an operator multiple grasping positions with added safety.

It is another objective of the present invention to provide a handle for a power tool such as a chain saw wherein the handle provides for use of the tool with either a left handed or right handed orientation of the tool without significantly increasing the overall size of the handle.

It is another objective of the present invention to provide for a two piece handle for a power tool such as a chain saw wherein the pieces form a structurally rigid closed loop.

It is another objective of the present invention to provide a handle for a power tool such as a chain saw which can substantially encircle a portion of the housing of the power tool.

SUMMARY OF THE INVENTION

The foregoing problems are overcome and other advantages are provided by a handle for use with an engine driven hand held power tool comprising two relatively U-shaped members that are connected to each other to form a closed loop handle.

In accordance with one embodiment of the invention, a handle is provided comprising a first member having a center section and two extending side sections which form a general U-shape. A second member is provided having a first portion with a center section and two extending side sections forming a general U-shape, and a second portion extending away from the first portion. Means are provided for connecting the first member side sections with the second member side sections to form a closed loop handle that can substantially surround a power tool body.

In accordance with another embodiment of the invention, a chain saw is provided having a motor, a housing forming a rear handle, a guide bar for accommodating a saw chain for movement thereon, a front handle for holding and guiding the chain saw. The front handle comprises a first member, a second member and means for connecting the first and second members together. The first member has a general U-shape and means for connecting the first member with the chain saw housing. The second member has a generally U-shaped section and means for connecting the second member with the chain saw housing. The means for connecting the first and second members together allows the front handle to form a generally closed loop shaped around the chain saw housing.

In accordance with one method of the invention, a method is provided for mounting a front handle onto a chain saw body comprising the steps connecting a bottom member to a body of the chain saw, the bottom member having a center span and two side legs forming a general U-shape; connecting a top member to the bottom member, the top member having a first section with a center span and two side legs and a second section, the bottom member side legs being at least partially received into the top member side legs; and connecting the top member second section with the body of the chain saw.

BRIEF DESCRIPTION OF THE DRAWINGS

The foregoing aspects and other features of the invention are explained in the following description, taken in conjunction with the accompanying drawings wherein.

DETAILED DESCRIPTION OF THE INVENTION

Figure 1:
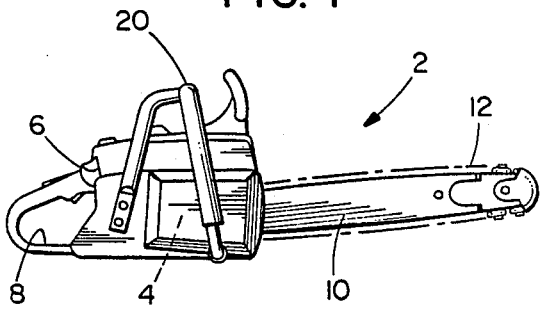
FIG. 1 is a side view of a chain saw having a handle incorporating features of the present invention.

Referring to FIG. 1, there is shown a plane side view of a chain saw 2 incorporating features of the invention. In the embodiment shown, the chain saw 2 generally comprises a motor 4, a housing 6, a rear handle 8 formed as part of the housing 6, a guide bar 10 for accommodating a saw chain 12 for movement thereon and a front handle 20. Generally, an operator while using the chain saw 2, holds the chain saw with one hand at the rear handle 8 and the other hand at the front handle 20. The front handle 20 generally performs the function of allowing the operator to grasp the front handle 20 at various different locations such that the operator can have a firm grip on the chain saw, but nonetheless orientate the guide bar 10 and saw chain 12 for a desired angle of cut.

Figure 2:
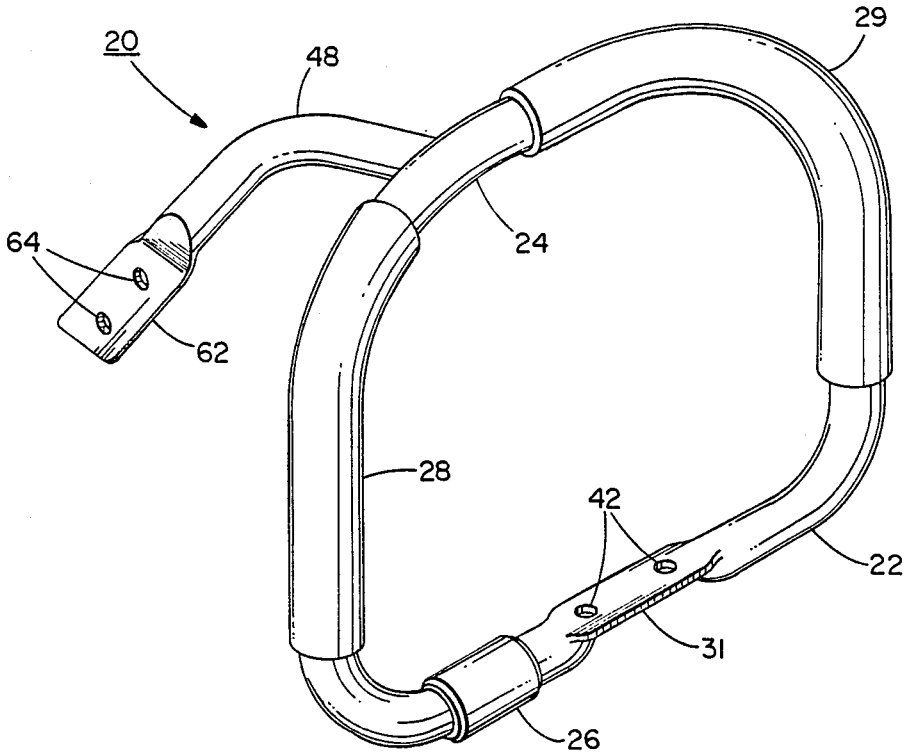
FIG. 2 is a perspective view of the handle shown in FIG. 1
Figure 3:
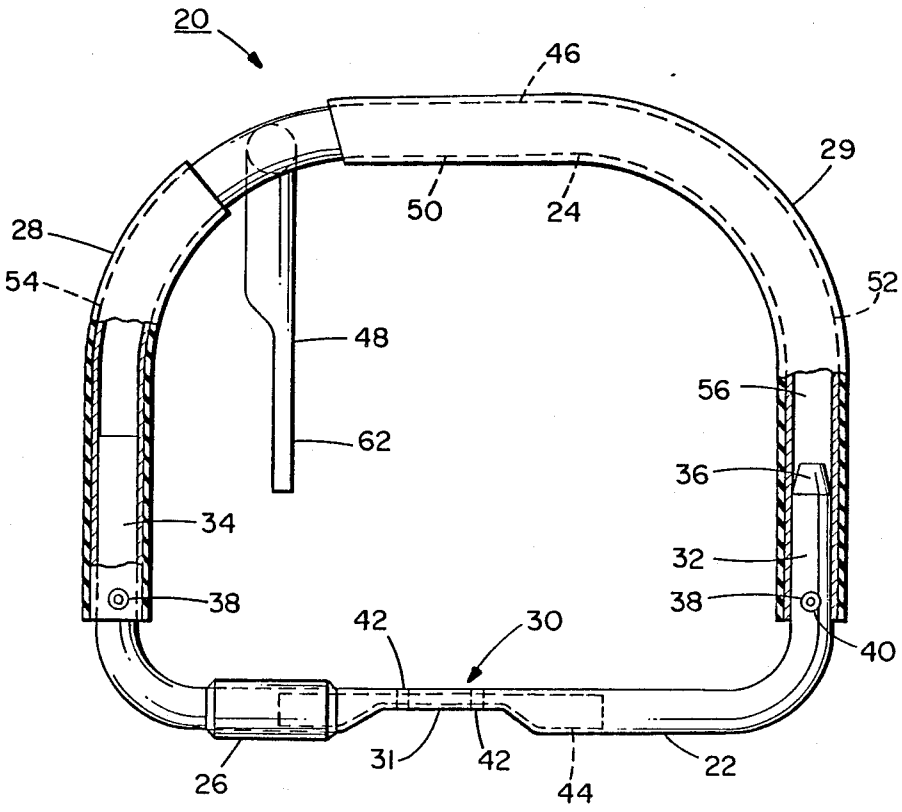
FIG. 3 is a partial cross sectional front view of the handle shown in FIG. 2.
Figure 4:
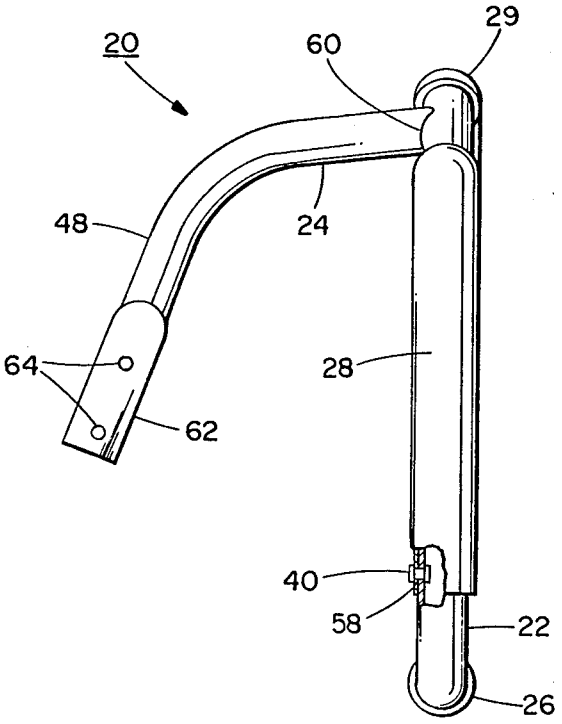
FIG. 4 is a side view of the handle shown in FIG. 2.

Referring also to FIGS. 2, 3 and 4 the front handle 20 of the chain saw 2 in FIG. 1 is shown. In this embodiment, the handle 20 generally comprises a bottom or lower member 22, a top or upper member 24, a chain guard 26 and two handle grips 28 and 29. In the embodiment shown, the bottom member 22 is generally U-shaped with a center span 30, a right leg 32 and a left leg 34. In the embodiment hhown, the end 36 of the right leg 32 is tapered. The end 36 of the left leg 34 is not tapered, however, in an alternate embodiment it can be tapered. The length of the left leg 34 is also longer than the length of the right leg 32 such that during assembly of the top member 24 and bottom member 22, the left leg 34 can be inserted into a left leg 54 of the top member 24 with the right leg 32 being inserted, in turn, into a right leg 52 of the top member 24. The tapered end 36 of the right leg 32 aids in inserting the bottom member right leg 32 into the top member right leg 52 and allows for easy alignment of the legs and easy assembly of the top and bottom members. Each leg 32, 34 also comprises mounting holes 38 for passage of a mounting member 40 therethrough. The mounting members 40, in the embodiment shown, are pop rivets. However, any suitable mounting means can be used. The bottom member 22 is generally comprised of a light weight tubular member made of a material such as aluminum or steel. However, any suitable material can be used. The center span or section 30 has a mounting section 31 which has been deformed to provide a relatively flat area for connection to the bottom of the chain saw 2. The mounting section 31 comprises two mounting holes 42 for passage of suitable mounting means such as screws or bolts through the bottom member 22 and into the housing 6 of the chain saw 2. In the embodiment shown, a stiffener 44 is provided with the center span 30 for added strength. The chain guard 26 is generally comprised of any suitable material such as plastic and is intended to protect the operator in the event that the chain 12 should come off of the gide bar 10 during operation of the chain saw 2. Basically, if the chain 12 is accidentally thrown off of the guide bar 10, the chain would come back at the operator under the chain saw 2. The chain guard 26 would prevent the chain 12 from reaching the operator by reducing the length that the chain 12 could go rearward by causing the chain 12 to go over the chain guard 26. In addition, the chain guard can also protect the cutting edges of the chain 12 if it is thrown off of the guide bar 10.

The top member 24 generally comprises two portions; a U-shaped portion 46 and an extending side bar portion 48. The U-shaped portion 46 generally comprises a center span 50, a right leg 52 and a left leg 54. The U-shaped portion 46 is generally comprised of a tubular member made of a suitable material such as aluminum or steel. However, any suitable material can be used. The tubular member of the U-shaped portion 46, in this embodiment, is slightly larger than the tubular member which forms the bottom member 22. The right and left legs 52, 54 generally have an inner diameter which is substantially equivalent to the outer diameter of the left and right legs 32, 34 of the bottom member 22. Thus, a center aperture 56 in the top member 24 can receive at least a portion of the right and left legs 32, 34 of the bottom member 22. During assembly of the top and bottom members, the bottom left leg 34 is first inserted into the top left leg 54. Then, the bottom right leg 32 is inserted into the top right leg 52. The tapered end 36 of the bottom member right leg 32 acts as a guide when initially inserting the lower leg 32 into the upper leg 52. The upper legs 52, 54 also comprise mounting holes 58 which can align with the mounting holes 38 of the lower legs 32, 34. Thus, with a pop rivet 40 inserted into the mounting holes 38, 58 the bottom member 22 and top member 24 are fixedly connected together.

The side bar portion 48 of the top member 24, in this embodiment, has a first end 60 which is fixedly connected to the U-shaped portion 46 between the center span 50 and the left leg 54. The side bar portion 48 generally extends away from the U-shaped portion 46 and in the embodiment shown in FIG. 1 the side bar portion 48 extends rearwardly and downwardly where it is connected to the chain saw housing 6. The side bar portion 48 has a second end 62 with holes 64 for passage of suitable mounting means therethrough. Thus the second end 62 can be securely fastened to the chain saw housing 6. The handle grips 28, 29 are generally comprised of any suitable material such as rubber and generally provide two functions. First, the handle grips 28, 29 allow the operator to have a firm slip resistant hold on the front handle bar 20. Second, the handle grips 28, 29 provide a vibration buffer between the chain saw 2 and the operator.

Figure 5:
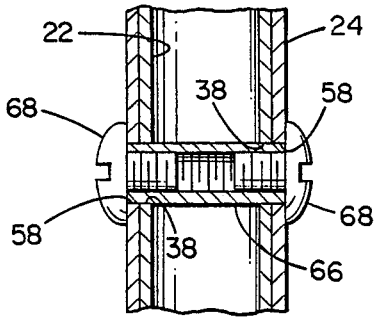
FIG. 5 is an enlarged partial cross sectional view of an alternate embodiment for mounting two members of the handle together.

Referring now to FIG. 5, there is shown an alternate means of mounting the upper member 24 with the lower member 22 proximate the mounting holes 38 and 58. In the embodiment shown, a spacer 66 is provided in the holes 38, 58 with two screws 68 mounted therein. With the use of this type of mounting members 40 between the upper and lower members, either the upper member 24 or the lower member 22 can be detached from the chain saw 2 without having to remove the other member of the front handle. In addition, this removable type of mounting means allows for replacement of either the upper or lower member without having to replace the entire front handle 20.

As is readily seen from the above description, the present invention comprises numerous advantages over the handles and handle bar designs previously known. A handle according to the present invention allows for side holding of the chain saw 2 on either the left or right side of the tool. A handle according to the present invention can have one member of the handle replaced without having to replace the entire handle. A handle according to the present invention provides for a more rigid handle assembly by providing a closed loop around the body of the chain saw as well as providing a side bar 48. In addition, a handle according to the present invention is relatively inexpensive to manufacture and relatively easy to assembly. A further advantage of the two piece U-shaped design described above is that the handle grips 28, 29 can be mounted on the U-shaped portion 46 of the top member 24 relatively easily. Afterwards, the lower member 22 can then be mounted to the upper member 24. The present invention allows for a relatively easy assembly of the handle to a chain saw or other hand-held power tool. Although the present invention has been described with regard to a chain saw, it could quite obviously be used with any hand-held power tool such as a grass trimmer. In addition, the two piece construction may be povided as left and right pieces rather than top and bottom pieces.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A handle for use with an engine-driven hand-held power tool, the handle comprising:

a first frame member having a center section and two extending side sections forming a general U-shape, said center section being fixedly and stationarily connectable to a power tool;

a second frame member having a first portion and a second portion, said first portion comprising a center section and two extending side sections forming a general U-shape, said second portion extending away from said first portion;

means for directly connecting said first member side sections with said second member side sections such that said first member general U-shape and said second member first portion general U-shape form a closed loop handle that can substantially surround a power tool body; and at least two handle grips being comprised of a slip resistant vibration absorbing material, said handle grips having a generally tubular shape and being slid onto said second member side sections prior to connection of said first and second members, said handle grips substantially covering said first portion whereby a closed loop handle is provided that is relatively easy to assembly, but which can provide an operator with various grasping locations, added safety and allow for rigid control of a power tool.

2. A handle as in claim 1 wherein said first member center section comprises means for connecting said first member to a bottom section of a power tool.

3. A handle as in claim 2 wherein said first member center section comprises a stiffener member.

4. A handle as in claim 1 wherein said first member center section comprises a chain guard.

5. A handle as in claim 1 wherein said first member has a relatively tubular cross-section shape.

6. A handle as in claim 1 wherein at least one of said first member side sections has a relatively tapered end.

7. A handle as in claim 1 wherein said first member side sections have mounting holes for passage of a mounting member therethrough.

8. A handle as in claim 1 wherein said second member side sections comprise a cavity for receiving at least a portion of said first member side sections.

9. A handle as in claim 8 wherein said second member side sections comprise mounting holes for passage of mounting members therethrough.

10. A handle as in claim 8 wherein said second member first portion has a relatively tubular shape.

11. A handle as in claim 1 wherein said second member second portion has a first end connected to said first portion proximate said second member center section and one second member side section and a second end having means for connecting said second portion to a power tool body.

12. A chain saw having a motor, a housing forming a rear handle, a guide bar for accommodating a saw chain for movement thereon, and a front handle for holding and guiding the chain saw, said front handle comprising:

a first member having a general U-shape formed by a first center section and a first two extending end sections, said first member having means for connecting said first member with said housing;

a second member having a generally U-shaped section, said U-shaped section being formed by a second center section and a second two extending end sections, said second member having means for connecting said member with siad housing;

means for directly connecting said first and second members together such that said front handle forms a generally closed loop shape around said housing and can be connected to and disconnected from said housing as separate members, said first member end sections and said second member end sections being connected to each other such that said first member general U-shape and said second member general U-shaped section form said generally closed loop shape; and a handle grip comprised of a slip resistant vibration absorbing material, said handle grip having a generally tubular shape and being mounted over said second member, said handle grip being slid onto said second member prior to connecting said second member with said first member whereby said handle grip can be relatively easily mounted to said second member and said first and second members can be relatively easily connected to each other during assembly of the front handle to the chain saw.

13. A chain saw as in claim 12 wherein said second member has a side branch section extending rearwardly and downwardly from said second member U-shaped section and having said means for connecting said second member with said housing thereon.

14. A chain saw as in claim 12 wherein said first member end sections and said second member end sections each have holes for receiving mounting members for fixedly connecting said first member with said second member.

15. A method of mounting a front handle onto a chain saw body comprising the steps of:

connecting a bottom member to a body of the chain saw, the bottom member having a center span and two side legs forming a general U-shape;

mounting a handle grip to a top member, the top member having a first section with a center span and two side legs forming a general U-shape and having a second section, the handle grip having a general tubular shape and being slid over a top member side leg;

connecting the top member, having the handle grip thereon, directly to the bottom member, the bottom member side legs being at least partially received into the top member side legs such that the bottom member general U-shape and the top member first section general U-shape form a substantially closed loop encircling the chain saw body; and connecting the top member second section with the body of the chain saw.

16. A method as in claim 15 wherein the step of connecting the top member to the bottom member comprises fixing the top and bottom members together by pop rivets.

* * * * *